US005806274A

United States Patent [19]

Wurtz et al.

[11] Patent Number: 5,806,274

[45] Date of Patent: Sep. 15, 1998

[54] FLOOR JOIST RETAINER AND METHOD FOR USING THE SAME

[75] Inventors: Timothy A. Wurtz; Ronald D. Wurtz, both of Meridian, Id.

[73] Assignee: JPL Enterprises, Inc., Meridian, Id.

[21] Appl. No.: 857,109

[22] Filed: May 15, 1997

[51] Int. Cl.[6] ..... E04B 1/38

[52] U.S. Cl. ..... 52/702; 52/698; 249/35

[58] Field of Search ..... 52/698, 699, 700, 52/701, 702; 249/35

[56] References Cited

U.S. PATENT DOCUMENTS 1,728,981 9/1929 Ropp ..... 52/702
1,785,790 12/1930 Ropp ..... 52/702
2,176,450 10/1939 Barnett ..... 52/699 X
3,894,368 7/1975 Crofoot ..... 52/105

*Primary Examiner*—Creighton Smith
*Attorney, Agent, or Firm*—Frank J. Dykas

[57] ABSTRACT

A floor joist retainer for use in a concrete foundation formed by pouring concrete into forms which has a floor joist retainer body having an open front side, closed sides and bottom, and open top side, and is sized to receive and support the end of a floor joist. The floor joist retainer is first attached to the interior surface of the interior form for the foundation wall at the desired elevation and the concrete then poured into the form and allowed to cure. When the forms are then removed, the floor joist retainer presents a body sized to receive and support a floor joist at a predetermined elevational level, irrespective of the final elevation of the top surface of the concrete foundation wall.

8 Claims, 6 Drawing Sheets

FLOOR JOIST RETAINER AND METHOD FOR USING THE SAME

BACKGROUND OF THE INVENTION

1. Technical Field

This invention generally relates to an apparatus and method for retaining a floor joist in a poured concrete foundation, and more particularly to a floor joist retainer for positioning within a poured concrete foundation for retaining an end of a floor joist.

2. Background

Modern construction techniques utilize poured concrete foundations for residential and some commercial buildings. The typical construction sequence begins with the excavation of the ground where the foundation is to be poured, after which a footing is poured between two wooden forms. Once the footing is cured, typically within 24 hours after the concrete is poured, additional foundation wall forms are erected on the footing in preparation for pouring concrete to form the foundation. The foundation wall is then poured and allowed to cure for approximately 24 hours.

Once the foundation is poured and cured, the forms, typically made of wood, are removed, and a sill plate is attached to the top of the foundation wall.

Floor joists are then attached to the sill plate, or set against the foundation wall in one of at least three fairly common procedures. The first is that metal bracket hangers are attached to, and hang from, the sill plate and the floor joist ends are set into them. A second method involves construction of a pony wall inside and adjacent to the foundation walls, and the third is to set the floor joists atop of the seal plate.

There are problems with these conventional construction techniques. In the first technique, utilizing the metal brackets, the brackets have to be nailed to the sill plate, and the floor joists are typically nailed within the brackets to hold them in position. This creates squeaks between the brackets and the wood, and results in a squeaky floor. Secondly, the sill plate and hence the floor joists follow the contour of the top of the foundation wall. For that reason, when the foundation wall is poured, great care must be taken to insure that its top surface is as level as possible so as to create a level floor when the floor joists are set in the brackets. Pouring a level foundation wall is difficult to do and requires skill, since the concrete is poured between wooden forms in such a manner that the top of the foundation wall cannot be easily sighted for purposes of leveling it.

In a like manner, the erection of pony walls adjacent to the inside of the foundation wall also presents leveling problems since the pony wall is erected atop of the original footing. Thus, if pony walls are to be used in the construction of the floor, great care must be taken when pouring the footings for the foundation wall to insure that the footings are level. This presents a problem, since the footings are usually below the grade of the ground, and it is difficult to insure that they are sighted and level. This construction technique also results in inherent squeaking of the floor joists when walked upon.

The third technique of setting the floor joists atop the sill plate inherently includes similar problems to that of the first technique using brackets, and also is prohibited in some regions of the country by building codes. It also results in a rather high elevation for the floor, which may be undesirable from an aesthetic point of view.

Accordingly, what is needed is a construction technique wherein the floor joists can be set level, and directly into the concrete foundation wall, so as to provide a firm, level and squeakless floor for the structure.

DISCLOSURE OF INVENTION

These objects are achieved in a floor joist retainer formed of plastic or other material to which poured concrete will adhere. The floor joist retainer is formed of a floor joist body, having fixed opposing sides, bottom, and back side to form a generally rectangular open-topped, open-face body which is configured in size and shape to retain and support an end of a particular size floor joist.

The floor joist retainer also has a removable top which is molded in such a manner that it can be easily knocked out and removed by tapping it with a hammer. This is accomplished by incorporating in the mold for the top, kiss cuts between the top, the back, and sides. A pair of retaining flanges are molded integrally with the floor joist retainer at the back side for purposes of securing the floor joist retainer within cured concrete. Also included are structural ridges interconnecting the flanges to the floor joist retainer body so as to prevent distortion of the configuration of the body when the concrete is poured.

Nail posts are formed integral with the side walls of the retainer and serve to hold nails in a position where they can be hammered straight into the inside surface of an interior foundation wall form. Nails are sized such that when they are hammered, the pointed ends will extend approximately one-half inch straight into a wooden concrete form.

The floor joist retainer is used in practice as part of what would otherwise be a conventional construction technique. First, the ground is excavated and a footing poured. Next, the foundation forms are set atop the cured concrete footing. A chalk line or other elevational marking is sighted on the interior surface of the interior forms at the desired elevation for the floor joists. Next, a plurality of floor joist retainers are nailed to the inside surface of the interior form at the appropriate intervals for the desired floor joists and are carefully positioned so that the top of the floor joist retainer is set precisely coincident to the elevational markings. This is followed by the pouring and curing of the concrete. Thereafter, the foundation wall forms are removed, and the tops of the floor joist retainers are knocked out to form a floor joist retainer body which is open at the top and face toward the interior of the foundation, and configured in a position to receive, hold and support the desired floor joists, all at the correct elevational level.

BEST MODE FOR CARRYING OUT INVENTION

Figure 1:
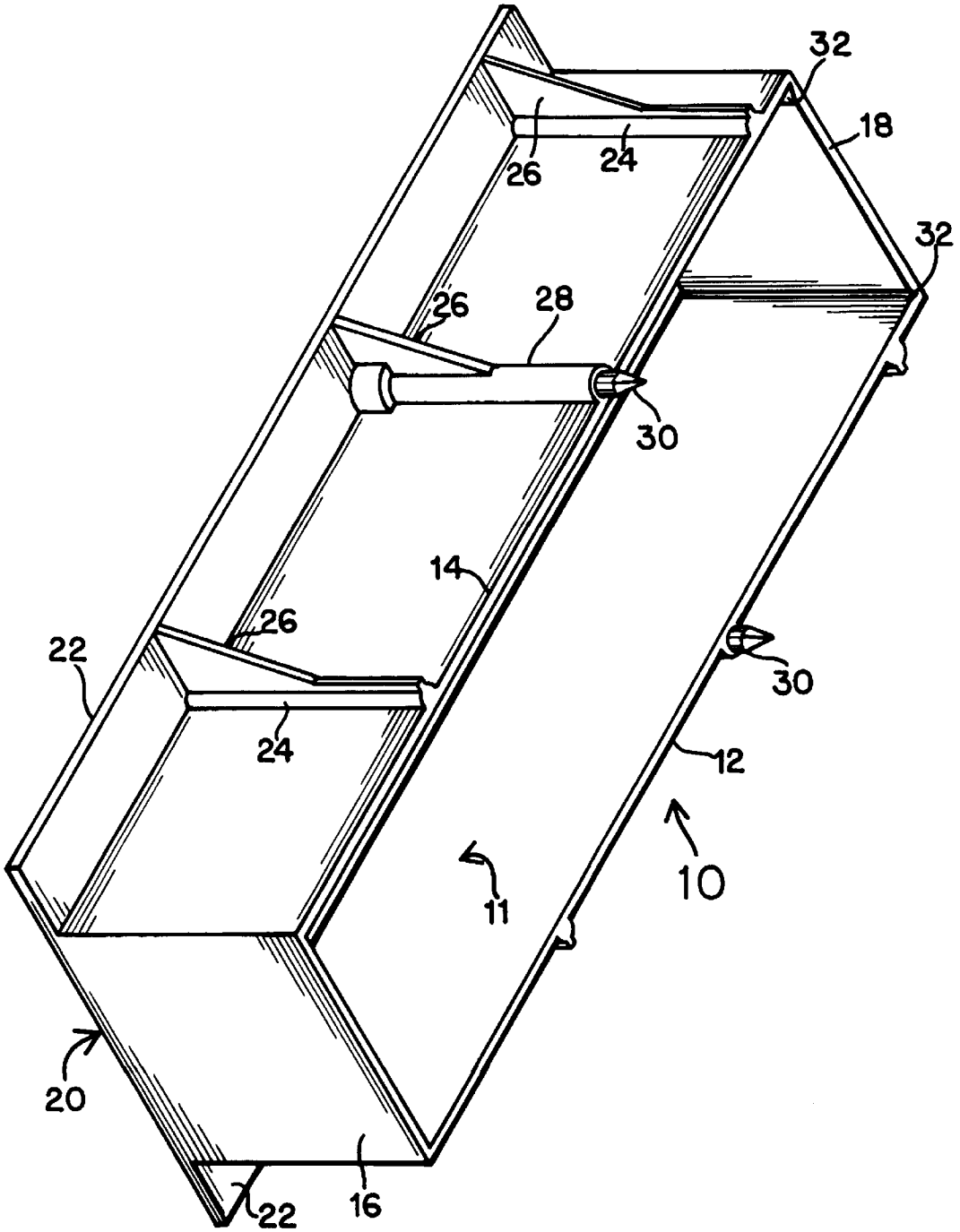
FIG. 1 is a perspective representational view of the floor joist retainer.

FIGS. 1, 3, 4 and 5 show the floor joist retainer 10 to advantage. In the preferred embodiment it is formed of plastic, such as polyethylene, polyvinylchloride, polypropylene material, or other material such that poured concrete will not adhere to it. The floor joist retainer is formed of a floor joist body having opposing sides 12 and 14, bottom 16 and back side 20 to form a generally rectangular, open-topped, open-faced body 11, which is configured in size and shape to retain and support an end of a particular sized floor joist. The floor joist, not shown, can be of any conventional type, either formed of dimensional lumber or an engineered wood product, such as a wooden I-beam floor joist.

In the preferred embodiment, floor joist retainer 10 also includes a removable top 18 which, in the preferred embodiment, is molded in such a manner that it can be easily knocked out and removed by tapping it with a hammer. This is accomplished in the preferred embodiment by incorporating in the mold for manufacturing floor joist retainer 10, a kiss cut 32 between back 20, sides 12 and 14 and top 18. A pair of retaining flanges 22 are molded integrally with floor joist retainer 10 at the back side. The purpose of retaining flanges 22 is to secure floor joist retainer 10 within the poured concrete after it is cured. Although in the preferred embodiment they are molded integral with the back side 20, it should be apparent to anyone skilled in the art that retaining flanges 22 could be of different sizes than that shown in the preferred embodiment and also positioned at any intermediate position between the open face and the back side.

Structural ridges 24 and ridge extensions 26 are also incorporated in the preferred embodiment to provide structural rigidity to floor joist retainer 10 so as to prevent distortion of the configuration of floor joist retainer 10 when the concrete is poured.

Figure 6:
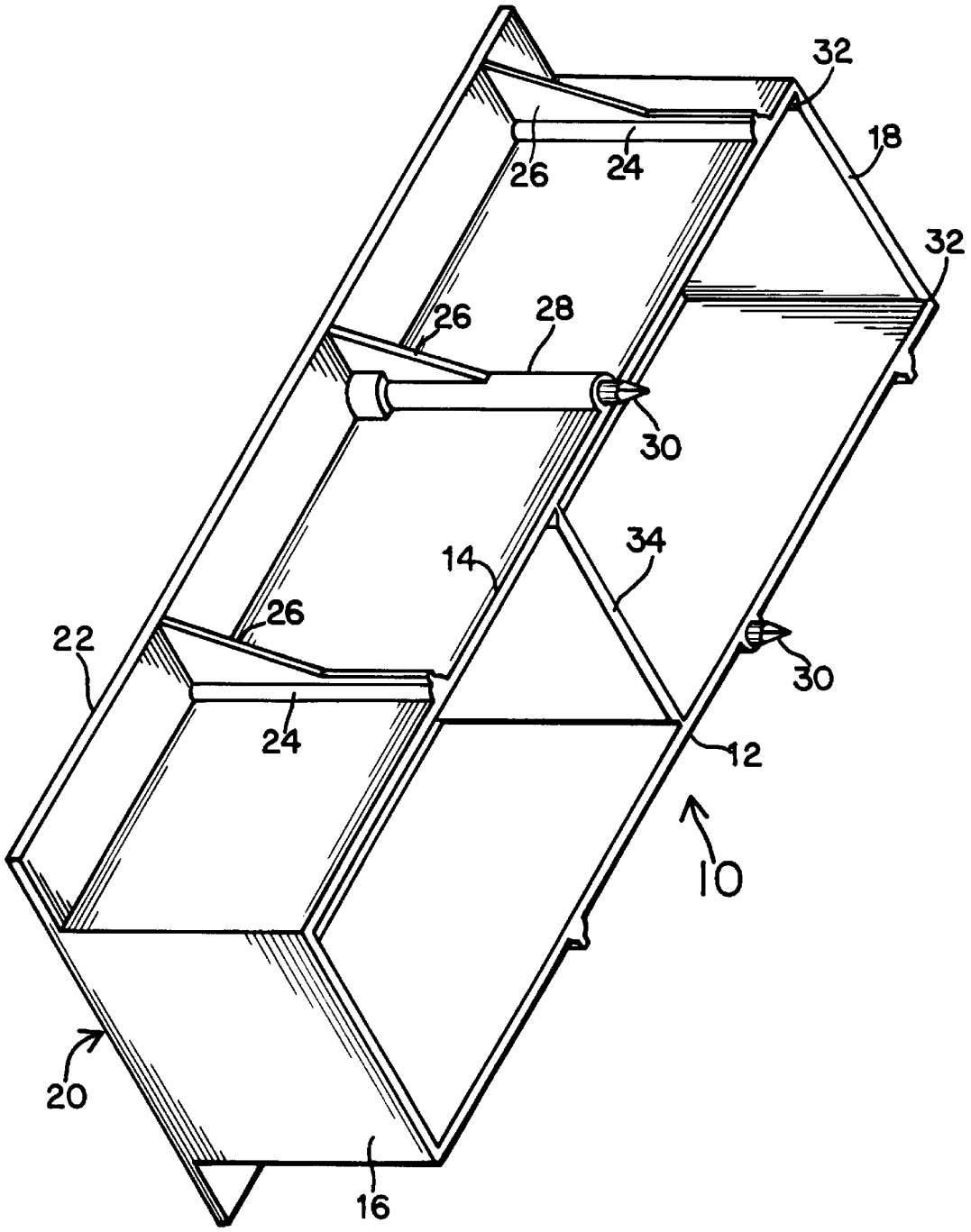
FIG. 6 is a perspective representational view of the second embodiment of a floor joist retainer.

FIG. 6 discloses a second preferred embodiment of the floor joist retainer 10 in which intermediate structural plate 34 is incorporated into the molded retainer 10 to provide for additional structural rigidity to the retainer for purposes of maintaining its correct configuration during the pouring of the concrete.

Figure 2:
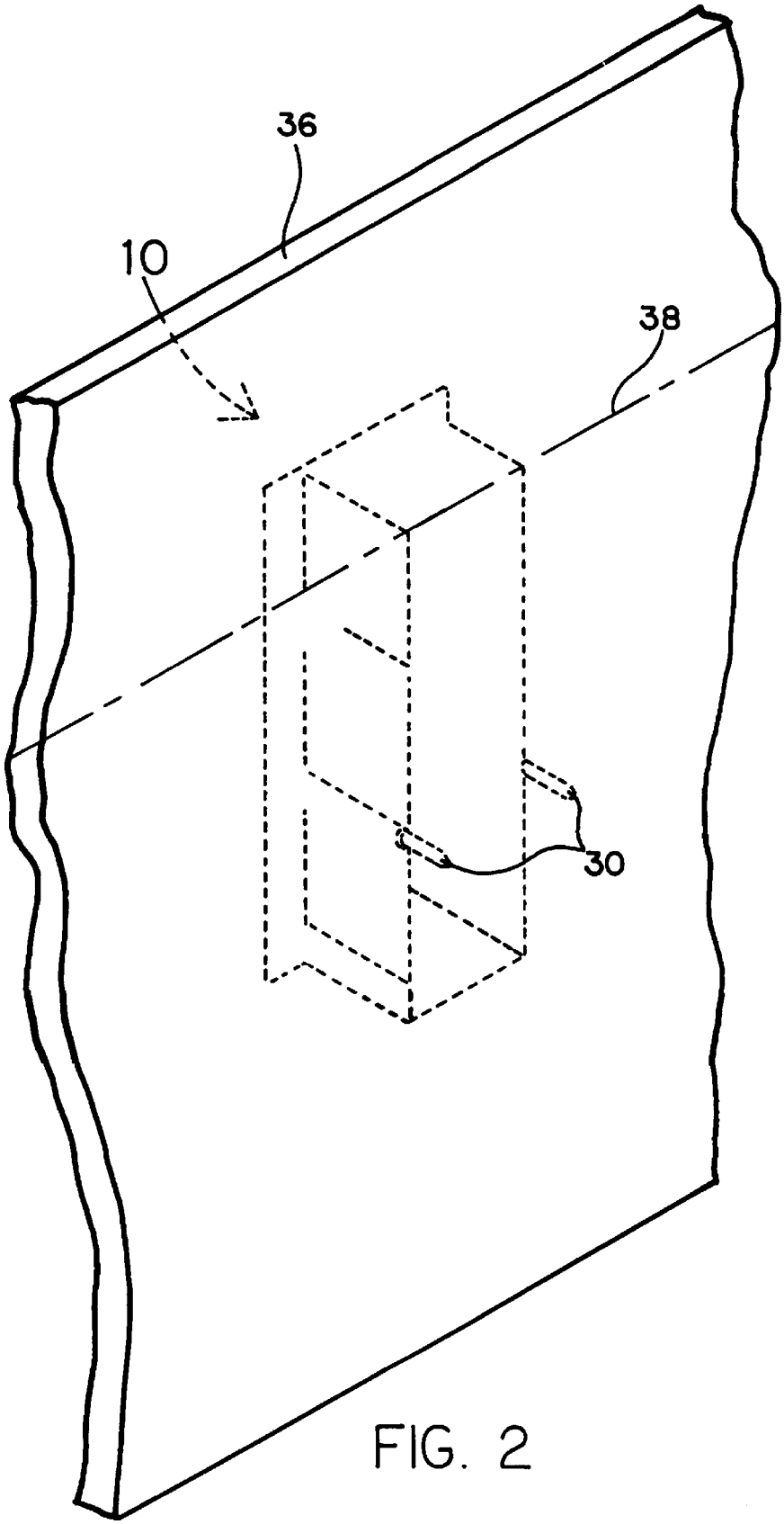
FIG. 2 is a perspective representational view of the floor joist retainer attached to the foundation wall form.
Figure 3:
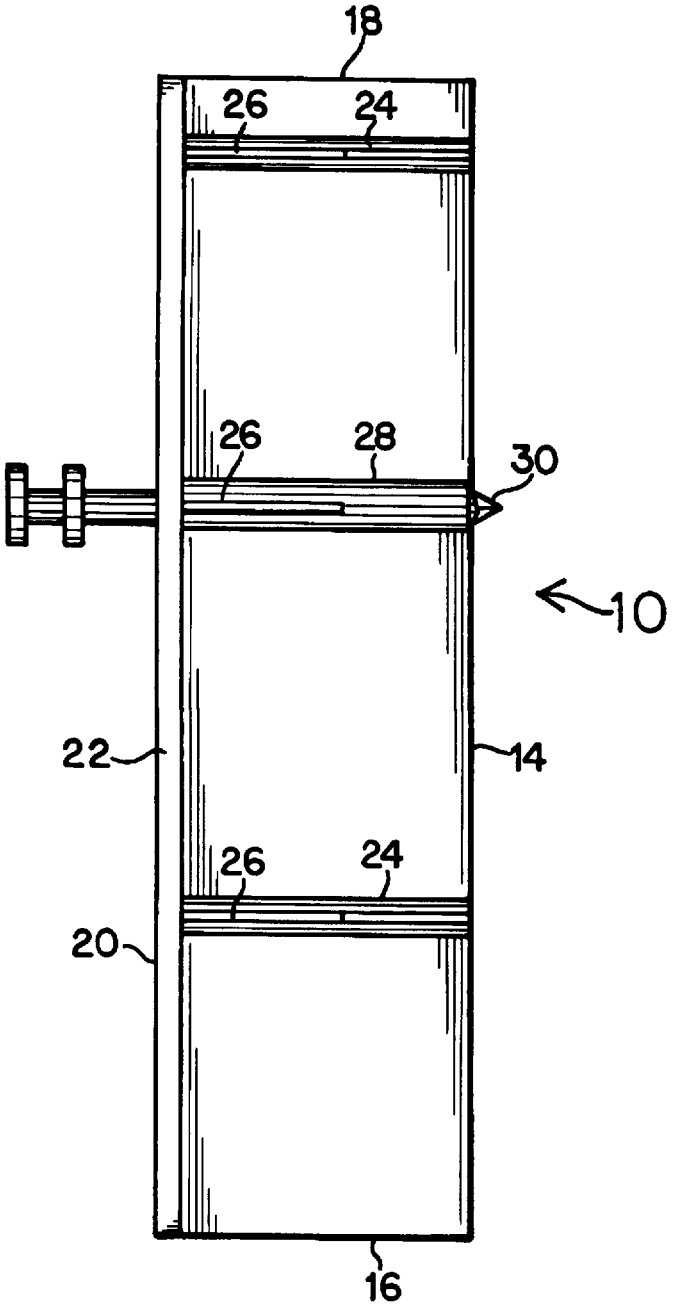
FIG. 3 is a side view of the floor joist retainer.
Figure 4:
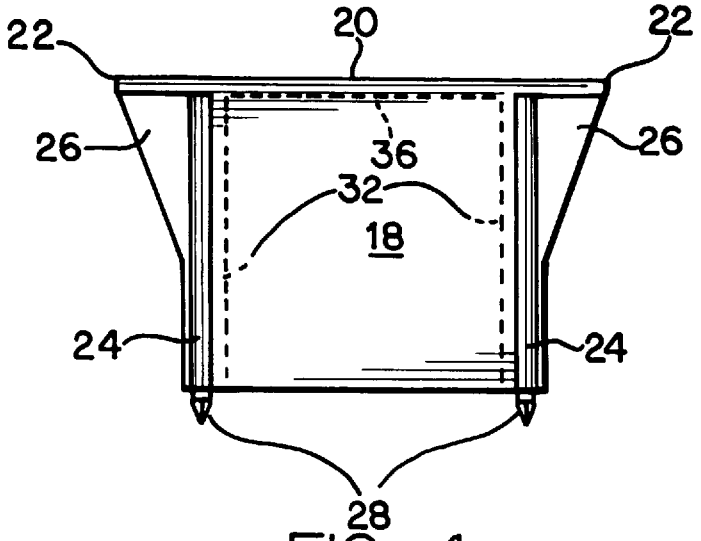
FIG. 4 is a top view of the floor joist retainer.
Figure 5:
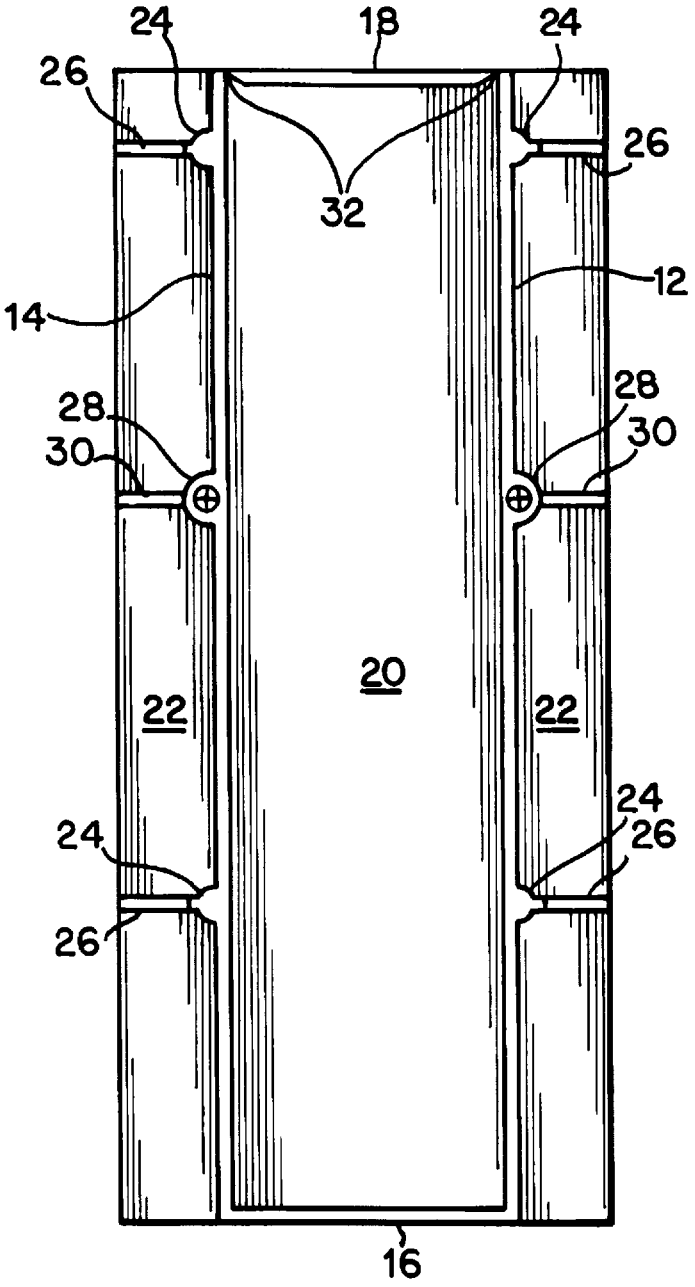
FIG. 5 is a front plan view of the floor joist retainer.

As shown in all of FIGS. 1 through 6, nail posts 28 are formed integral with retainer 10 and serve to hold nails 30 in a position where they can be easily hammered to attach the retainers 10 to the inside surface of a foundation wall form, as shown in FIG. 2. In the preferred embodiment, nails 30 are double headed, so as to provide additional attachment flanges for the retainer 10 to be held by the poured concrete, although any standard nail will work. Also in the preferred embodiment, nails 30 are sized such that when hammered, the pointed ends will extend approximately one-half inch straight into a wooden concrete form. It has been found in practice that this is a sufficient extension to hold floor joist retainers 10 against the surface of a wooden form when concrete is being poured.

In practice, the construction of the foundation which incorporates floor joist retainers 10 begins in a conventional manner with the excavation, forming and pouring of a footing. When the footing cures, typically 24 hours later, conventional, usually wooden forms are used for forming a foundation wall and are installed atop the footing in preparation for pouring concrete.

At this point an elevational line is affixed to the inside surface of the interior form 36, typically by snapping a chalk line 38 as shown in FIG. 2. This elevational line 38 is the desired elevational top surface which represents the desired elevational top surface of the finished concrete foundation wall.

At this point, a plurality of floor joist retainers 10 are nailed to the inside surface of the interior form at the appropriate intervals for the desired floor joists and are carefully positioned so that the top 18 of each floor joist retainer 10 is set precisely coincident to the elevational chalk line 38. The floor joist retainers 10 are thus attached, with their open faces against the inside surface of the interior form 36 at a precise, uniform and accurate elevation which is independent of whether or not the eventual concrete wall elevation is precise and accurately elevated.

After positioning the floor joist retainers 10 to form 36, the concrete is then poured into the forms and allowed to cure, thus forming the foundation wall. The conventional concrete forms are then removed. In practice, it has been found that the forms can be easily pulled away from extending nails 30. Extending nails 30, once the forms are removed, extend out approximately one-half inch from the concrete, but since it is on the interior surface of the foundation wall, they can generally be ignored or they can be hammered down or chipped off with a chisel.

Top 18 and intermediate structural plate 34 if included can then be easily struck with a hammer or other tool to pop them out, thus providing structural support for supporting the side walls during the concrete pour. Also, in practice, if any concrete seeps into the body 11, it can be easily brushed or popped out once the forms are removed.

In this manner, a concrete foundation for a structure can be formed to provide for accurately spaced and level floor joists, even if the top surface of the foundation wall may still not be level, and thus while the sill plate and the walls of the structure will follow the uneven elevation of the foundation, but at least the floor will be level.

Also, in practice it has been found that floor joists retained by floor joist retainers 10 do not squeak nearly to the extent that floor joists squeak when retained in metal brackets and/or by resting atop of pony walls.

While there is shown and described the present preferred embodiment of the invention, it is to be distinctly understood that this invention is not limited thereto but may be variously embodied to practice within the scope of the following claims.

I claim:

1. A floor joist retainer, for use in a concrete foundation formed by pouring concrete into forms, which comprises:

a floor joist retainer body having an open front side, and closed sides, a back side and a bottom, and a removable top side, and configured to receive and support an end of a floor joist positioned within said floor joist retainer body through the open top and front said removable top side for attachment with the floor joist retainer body when it is attached to the form and is removable after the concrete is poured;

a retaining flange attached to said floor joist retainer body for engagement within the concrete foundation; and removable means for removably attaching said floor joist retainer body to the form before the concrete is poured into the forms.

2. The floor joist retainer of claim 1 wherein the removable means for attaching the floor joist retainer body to the form comprises a plurality of nails.

3. The floor joist retainer of claim 1 wherein said floor joist retainer body is formed of material to which poured concrete will not adhere.

4. The floor joist retainer of claim 1 which further comprises an intermediate structural plate interconnecting the sides and back of said floor joist retainer body which is attached to said sides and back when the concrete is poured into the forms and removable after said concrete is poured.

5. A floor joist retainer, for use in a concrete foundation formed by pouring concrete into forms, which comprises:

a floor joist retainer body having an open front side, and closed sides, a back side and a bottom, and an open top side, and configured to receive and support an end of a floor joist positioned within said floor joist retainer body through the open top and front;

a retaining flange attached to said floor joist retainer body for engagement within the concrete foundation;

a plurality of nail posts attached to the sides of said floor joist retainer body, each positioned and configured to hold a nail with a pointed end extending into the form; and a plurality of nails positioned within said nail posts and configured in size to extend a pointed end into a form.

6. The floor joist retainer of claim 1 wherein said floor joist retainer body is formed of material to which poured concrete will not adhere.

7. A method of positioning and supporting a floor joist within a concrete foundation formed by pouring concrete into forms using a floor joist retainer having a floor joist retainer body having an open front side, closed sides and bottom, and a removable top side, and configured to receive and support an end of a floor joist positioned within said floor joist retainer body through the open top and front, a retaining flange attached to said floor joist retainer body for engagement within the concrete foundation, and means for removably attaching said floor joist retainer body to the form before the concrete is poured into the forms, which comprises:

positioning and attaching said floor joist retainer to a form with the removable top side attached to the floor joist retainer body before the concrete is poured with the open front facing said form;

pouring the concrete into the forms;

curing the concrete;

removing the forms;

removing the removable top side from the floor joist retainer body; and positioning an end of the floor joist into the floor joist retainer body.

8. A method of positioning and supporting a floor joist within a concrete foundation formed by pouring concrete into forms using a floor joist retainer having a floor joist retainer body having an open front side, closed sides and bottom, and a removable top side, and configured to receive and support an end of a floor joist positioned within said floor joist retainer body through the open top and front, a retaining flange attached to said floor joist retainer body for engagement within the concrete foundation, a plurality of nail posts attached to the sides of said floor joist retainer body, each positioned and configured to hold a nail with a pointed end extending into the form, and a plurality of nails positioned within said nail posts and configured in size to extend a pointed end into a form said floor joist retainer body to removably attach said floor joist retainer to said form before the concrete is poured into the forms, which comprises:

positioning and nailing said floor joist retainer to a form, with the open front facing the form with the removable top side attached to the floor joist retainer body, before the concrete is poured into said forms;

pouring the concrete into the forms;

curing the concrete;

removing the forms;

removing the removable top side from the floor joist retainer body; and positioning an end of the floor joist into the floor joist retainer body.

* * * * *